US006058798A

United States Patent [19]

Lantzsch

[11] Patent Number: 6,058,798

[45] Date of Patent: May 9, 2000

[54] INFINITELY ADJUSTABLE LIFTING MOUNTING

[75] Inventor: Hans Lantzsch, Dortmund, Germany

[73] Assignee: Recticel Internationale Bettsysteme GmbH, Holzwickede, Germany

[21] Appl. No.: 09/183,941

[22] Filed: Nov. 2, 1998

[30] Foreign Application Priority Data

Nov. 11, 1997 [DE] Germany ..... 297 19 776 U

[51] Int. Cl.[7] ..... G05G 5/24; E05B 55/06; A47C 1/025

[52] U.S. Cl. ..... 74/530; 5/618; 5/660; 49/394; 297/327; 297/337; 74/586

[58] Field of Search ..... 74/530, 586; 5/618, 5/660, 634; 49/394; 297/313, 325, 326, 327, 337

[56] References Cited

U.S. PATENT DOCUMENTS

| | | | |
|---|---|---|---|
| 2,420,555 | 5/1947 | Mott | 74/530 |
| 2,672,061 | 3/1954 | Gardner | 74/530 |
| 3,403,581 | 10/1968 | Harness | 74/530 |
| 4,666,210 | 5/1987 | Bianchi et al. | 74/530 X |
| 5,167,166 | 12/1992 | Ruhlman | 74/530 X |

FOREIGN PATENT DOCUMENTS

| | | |
|---|---|---|
| 7704457 | 2/1977 | Germany . |
| 4129496 | 9/1991 | Germany . |

*Primary Examiner*—Allan D. Herrmann
*Attorney, Agent, or Firm*—Friedman Siegelbaum, LLP

[57] ABSTRACT

With a device for the infinite adjustment of a telescopic rod for fixing pivotable elements into an open position and returning them into a closed position, and for raising and lowering adjustable head and leg parts of a bed, a couch and an armchair, the invention is directed to making infinite raising possible while retaining the return from the upper dead center position into the lower dead center position after the former has been reached. This is achieved by a toothed rack, a cage-like element and two toothed wheels which run along the toothed rack, are guided in the cage-like element and whose spacing can be moved by the rod from a position locking the teeth of the toothed wheels against one another into a position which disengages the teeth.

12 Claims, 2 Drawing Sheets

16
2'
13
1a
3
5
3a
11
10
9
6
7
8a
4
4a
IV
IV

2'
11
4a
7
10
16
5
9
3a
6

INFINITELY ADJUSTABLE LIFTING MOUNTING

FIELD OF THE INVENTION

The invention is focused on a device for the infinite adjustment of a telescopic rod for fixing pivotable elements into an open position and returning them into a closed position, or for raising and lowering an adjustable head or leg part of a bed, a couch, an armchair or the like.

BACKGROUND OF THE INVENTION

There is a series of applications in which an infinite adjustment option is desirable, for example, in the case of the adjustment option for a skylight, bringing window areas into a ventilation position, other ventilation flaps also being similarly movable, pivoting flaps on cooker extractor hoods or the like.

An extremely wide range of use of adjustment mountings of this type resides in the raising and lowering of an adjustable head or leg part of a bed, a couch, an armchair or the like. Mountings of this type, which frequently have toothed racks, are disclosed, for example, in DE-C-41 29 496, DE-C-22 62 947, DE-A-23 30 442, DE-A-38 02 962, DE-C-39 13 821 or EP-A-0 538 577, to name just some examples, and German Utility Model 77 04 457 shows the sliding mechanism without toothed racks.

An essential feature of the known solutions as furniture mountings is that, for example, the head part of a bed can only ever be raised in the incremental steps of the toothed ratchet rod or in notches made in guide elements. Bracing and fixing take place in a step sequence in each case. The solutions are envisaged such that when a maximum adjustment is reached, this position is exceeded via special mountings and devices in that the notches can be guided beyond the individual recesses into the lower dead center position in order once again to be able to bring about the stepwise raising.

The object of the present invention is to make infinite raising possible while retaining the return from the upper dead center position into the lower dead center position after the former has been reached.

Using a device of the type described at the beginning, this object is achieved according to the invention by means of two toothed wheels which run along a toothed rack, are guided in a cage or the like and whose spacing apart can be moved by means of the rod from a position locking the teeth of the toothed wheels against one another into a position which disengages the teeth.

The combination of a toothed rack having two toothed wheels which are guided on it and run along it and whose spacing apart can be influenced by the telescopic rod makes it possible for the telescopic rod to take up any position desired between a first dead center position and pull-out dead center position, in such a manner that adjustment steps no longer have to be kept to.

Refinements of the invention emerge from the subclaims, it being particularly expedient if the toothed wheels are guided in the interior of a housing, at least part of one housing wall being designed as a toothed rack.

This integration of the toothed rack directly into the housing guiding the toothed wheels ensures a very compact and simple design.

A further, simple design solution is if on the cage one toothed wheel axis is guided in a positionally fixed manner and one toothed wheel axis is guided such that it can be displaced in the pull or push direction, the pull and push being applied by means of the adjustable rod.

The displaceable toothed wheel axis can be guided in an elongated hole or slot in the cage, at least one dog, which can be overcome using an increased pulling or pushing force, being assigned to the path of movement of the toothed wheel axis.

This dog has the result that that toothed wheel which can be moved out of engagement initially positions itself with its axis against this dog in order to make it possible for the pull rod to be displaced from the lower dead center position into the pulled-up dead center position. If the upper dead center position is reached, a further force is applied, the dog is overcome and the toothed wheel is thereby permanently disengaged from the toothed wheel guided in a stationary manner in the cage, with the result that pivoting back from the upper dead center position into the lower dead center position is possible.

In this case, it is advantageous if, as the invention likewise envisages, the cage or the toothed wheel guide protrudes to such an extent over the toothed wheels that in the one pull-out position (upper dead center position) of the telescopic rod, the cage initially positions itself against the housing wall and in so doing makes possible the further path of adjustment of the movable toothed wheel axis via the telescopic rod. As already mentioned above, this path of adjustment comprises overcoming the latching dog and obtaining a return run.

The housing and/or the toothed wheels and/or the telescopic rod are advantageously made of plastic, for example polyamide, it also being possible for other materials to be provided for some elements.

BRIEF DESCRIPTION OF THE DRAWINGS

The invention is explained in more detail below with reference to the drawing and by way of example in which.

DETAILED DESCRIPTION OF THE PREFERRED EMBODIMENT

Figure 1:
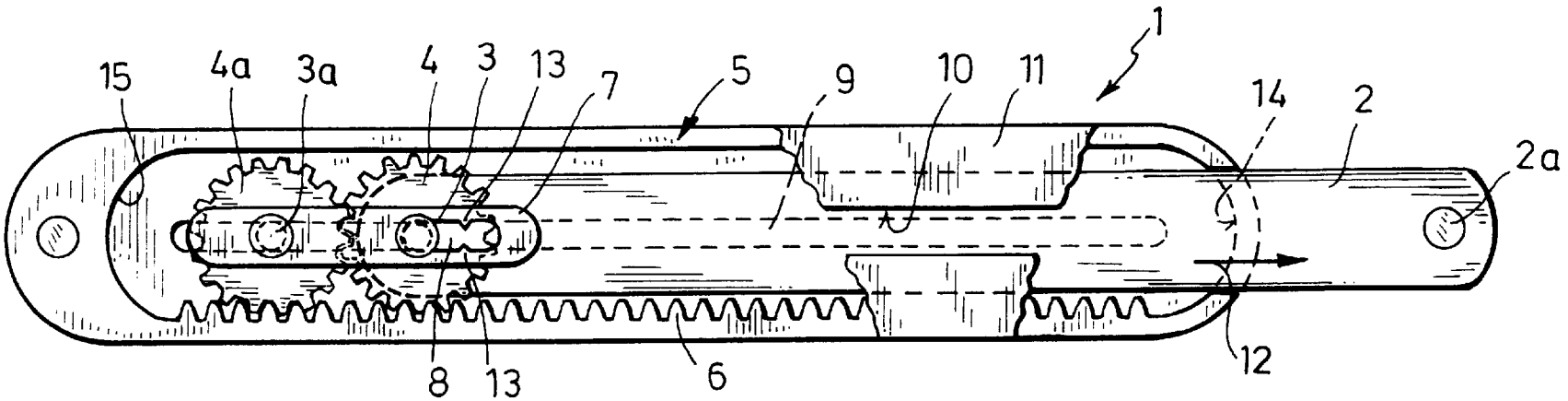
FIG. 1 shows the side view or aspect of a housing having a pair of toothed wheels guided therein, in the latching position.

The device, which has the general designation of 1 in FIG. 1, serves for the infinite adjustment of a telescopic rod 2 which is connected at a side 2*a* to an adjustable element (not shown in more detail in the figures), and on its other side interacts with a toothed wheel shaft 3 of a toothed wheel 4.

The toothed wheel 4 is guided within a housing body 5, one inner wall 6 of the housing body 5 being designed as a toothed rack along which the toothed wheel 4 can roll.

The toothed wheel 4 is guided in a cage 7 (only reproduced in outline) or a comparable device, this cage 7 merely being configured in the figures as a cage rod 7 which is equipped with a longitudinal slot 8 in the region of the shaft 3 of the toothed wheel 4.

Next to the toothed wheel 4, the cage rod 7 bears a further toothed wheel 4*a* on a toothed wheel shaft 3*a* fixed on the said rod, the toothed wheels 4 and 4*a* corresponding in size and toothing and both being able to roll along the toothed rack 6.

Figures 3, 4:
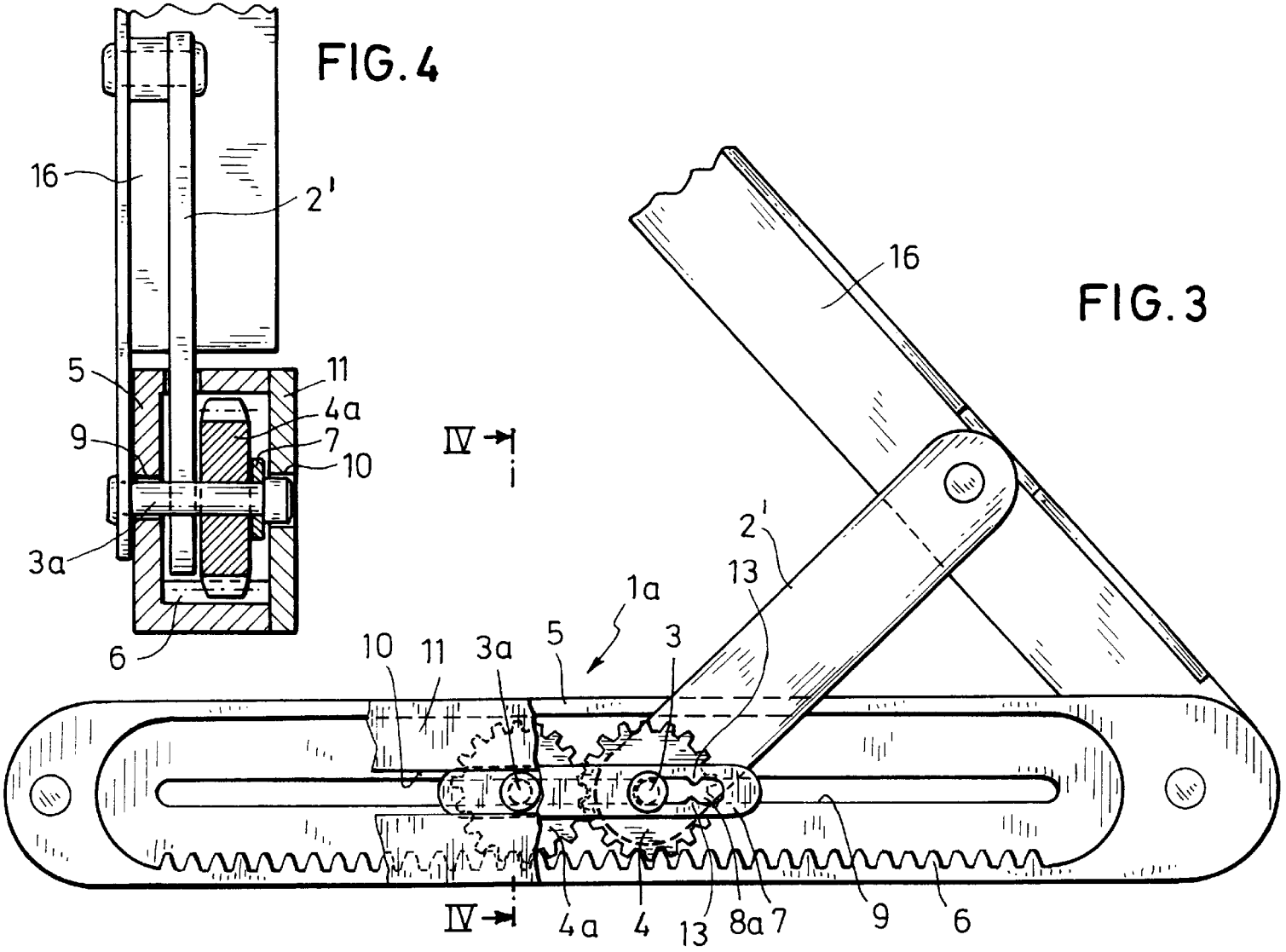
FIG. 3 shows a modified exemplary embodiment of the invention as a scissors-type adjustment.
FIG. 4 shows a section through the housing approximately along the line IV—IV in FIG. 3.

The two toothed wheel shafts 3 and 3*a* are guided, on the one hand, in a slot 9 in a housing wall and, on the other hand, in a housing slot 10 in the cover which is designated by 11 and which is merely outlined in FIG. 1, and to this extent reference should be made to the sectional FIG. 4.

For the infinite adjustment of the rod 2, the rod 2 is, for example, pulled out of the position which is shown in FIG. 1 and in which the two toothed wheels 4 and 4*a* are in engagement with one another and thus blocked via the toothed rack 6, to the right approximately in accordance with arrow 12 in FIG. 1. In this manner, the toothed wheel shaft 3 of the toothed wheel 4 is likewise pulled to the right and is adjusted in the longitudinal slot 8 of the cage rod 7.

Figure 2:
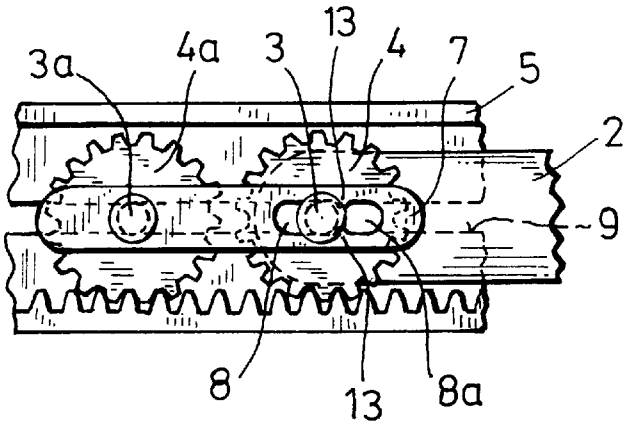
FIG. 2 shows a detail from the housing with the pair of toothed wheels in the adjustment position.

As can be seen in particular in FIG. 1, this slot is equipped with inwardly pointing locking dogs 13 which are dimensioned such that in the case of a normal pull, the shaft 3 cannot overcome these dogs. This disengaged position of the toothed wheels 4 and 4*a* is reproduced in FIG. 2. As can be seen, when the shaft bears against the dogs 13 there still remains a longitudinal slot region 8*a* into which the shaft 3 of the toothed wheel 4 can penetrate whenever the cage rod 7 is positioned at the right end 14 of the inner housing wall, if the rod 2 is pulled out further.

If this force is applied, the shaft 3 is pulled over and beyond the dogs 13, with the result that in the case of a reverse movement of the pull rod 2 counter to the arrow direction of the arrow 12, the two toothed wheels 4 and 4*a* do not come into engagement again and therefore an infinite return can take place until the toothed wheel 4*a* strikes against the left, inner housing wall 15, with the result that when the rod 2 is pushed further, the toothed wheel shaft 3 overcomes the dog 13 and can be guided left to such an extent that the toothed wheel 4 again comes into a locking position with the toothed wheel 4*a*.

On the intermediate path between the two extreme positions, the two toothed wheels 4 and 4*a* either mesh together, or else an adjustment is possible because the toothed wheel 4 is positioned with its shaft against the dog 13 and free mobility of the two toothed wheels is thereby ensured. If the pull-out direction is reversed, i.e. the rod is pushed to the left into an intermediate position, the toothed wheel 4 immediately engages into the teeth of the toothed wheel 4*a*, with the result that locking of the elements together is undertaken via the toothed rack 6.

FIG. 3 shows a modified exemplary embodiment, the telescopic rod 2 here being formed by a lever rod 2', for example for the lifting mounting of a bed head or bed leg part, which mounting is fastened, for example, by its frame to the angular rail 16. The other conditions are identical to those in FIG. 1 and 2, the device here is given the general designation 1*a*.

Of course, the described exemplary embodiments of the invention can be further modified in many respects without departing from the basic concept. It may thus be pointed out here that the housing 5 and the cover 11 can preferably be made of a polyamide plastic, the pull rod 2, the lever 2' and the angular rod 16 of a metal, in particular a light metal, it being possible for other materials to be used in a similar manner here, this also being true, for example, for the material of the toothed wheels 4 and 4*a*.

While the preferred and alternate embodiments of the invention has been depicted in detail, modifications and adaptations may be made thereto without departing from the spirit and scope of the invention as delineated in the following claims:

What is claimed is:

1. A device for the infinite adjustment of a telescopic rod for fixing pivotable elements in an open position and returning them into a closed position, and for raising and lowering adjustable head and leg parts of a bed, a couch and an armchair, wherein said device comprises:

a toothed rack;

a cage like element; and two toothed wheels which run along the toothed rack and are guided in the cage-like element;

wherein a spacing can be moved by the rod from a position locking the teeth of the toothed wheels against one another into a position which disengages the teeth; and wherein the toothed wheels are guided in the interior of a housing, wherein at least part of one housing inner wall is designed as the toothed rack.

2. The device of claim 1, wherein:

one toothed wheel axis (4*a*) on the cage is guided in a positionally fixed manner; and one toothed wheel axis (4) is guided such that it can be displaced in a pull or push direction.

3. The device of claim 2, further comprising:

an elongated aperture in which the displaceable toothed wheel axis is guided; and at least one locking projection which can be overcome using increased pulling or pushing force in the path of movement of the toothed wheel axis.

4. The device of claim 3, wherein the cage or the toothed wheel guide protrudes to such an extent over the toothed wheels that in a pulled-out position of the telescopic rod, the cage initially positions itself against the housing wall making possible the further path of adjustment of the movable toothed wheel axis over projections.

5. The device of claim 4, wherein at least one of the housing and the toothed wheels are made of plastic and the telescopic rod is preferably made of light metal.

6. The device of claim 1, wherein a toothed wheel axis on the cage is guided in a positionally fixed manner and a toothed wheel axis is guided such that it can be displaced in pull or push direction.

7. The device of claim 1, further comprising:

an elongated aperture in which a displaceable toothed wheel axis is guided; and at least one locking projection which can be overcome using increased pulling or pushing force in the path of movement of the toothed wheel axis.

8. The device of claim 1, further comprising:

an elongated aperture in which a displaceable toothed wheel axis is guided; and at least one locking projection which can be overcome using increased pulling or pushing force in the path of movement of the toothed wheel axis.

9. The device of claim 1, wherein the cage or a toothed wheel guide protrudes to such an extent over the toothed wheels that in a pulled-out position of the telescopic rod, the cage initially positions itself against a housing wall, making possible further path of adjustment of a movable toothed wheel axis over projections.

10. The device of claim 1, wherein the cage or a toothed wheel guide protrudes to such an extent over the toothed wheels that in a pulled-out position of the telescopic rod, the cage initially positions itself against the housing wall, making possible further path of adjustment of a movable toothed wheel axis over projections.

11. The device of claim 2, wherein the cage or a toothed wheel guide protrudes to such an extent over the toothed wheels that in a pulled-out position of the telescopic rod, the cage initially positions itself against the housing wall, making possible further path of adjustment of a movable toothed wheel axis over projections.

12. The device of claim 6 wherein the cage or a toothed wheel guide protrudes to such an extent over the toothed wheels that in a pulled-out position of the telescopic rod (2), the cage initially positions itself against the housing wall, making possible further path of adjustment of the movable toothed wheel axis over projections.

* * * * *